US007618236B2

(12) United States Patent
Hsu et al.

(10) Patent No.: US 7,618,236 B2
(45) Date of Patent: Nov. 17, 2009

(54) FAN AND FAN HOUSING WITH TOOTHED-TYPE CONNECTING ELEMENTS

(75) Inventors: Shuo-Shiu Hsu, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 297 days.

(21) Appl. No.: 11/407,936

(22) Filed: Apr. 21, 2006

(65) Prior Publication Data

US 2007/0116564 A1 May 24, 2007

(30) Foreign Application Priority Data

Nov. 18, 2005 (TW) ..... 94140587 A

(51) Int. Cl.
*F01D 9/02* (2006.01)

(52) U.S. Cl. ..... 415/208.2; 415/211.2; 415/121.2; 415/914

(58) Field of Classification Search ..... 415/121.2, 415/185, 191, 208.2, 914; 416/247 R
See application file for complete search history.

(56) References Cited

U.S. PATENT DOCUMENTS

| | | | | | |
|---|---|---|---|---|---|
| 4,089,618 | A * | 5/1978 | Patel | 416/228 |
| 4,318,669 | A * | 3/1982 | Wennerstrom | 415/119 |
| 4,482,302 | A * | 11/1984 | Grignon | 417/354 |
| 4,761,115 | A * | 8/1988 | Hopfensperger | 415/119 |
| 5,603,607 | A * | 2/1997 | Kondo et al. | 416/228 |
| 2004/0146395 | A1 * | 7/2004 | Uselton | 415/119 |

* cited by examiner

*Primary Examiner*—Igor Kershteyn
(74) *Attorney, Agent, or Firm*—Birch, Stewart, Kolasch & Birch, LLP

(57) ABSTRACT

A fan of the present invention includes a fan housing and an impeller disposed in the fan housing. The fan housing includes a plurality of connecting elements at its air outlet. Each connecting element includes a plurality of air-guiding teeth thereon, which can guide the air to flow smoothly out from the fan housing so as to increase airflow and air pressure, and reduce the noise.

20 Claims, 7 Drawing Sheets

FAN AND FAN HOUSING WITH TOOTHED-TYPE CONNECTING ELEMENTS

BACKGROUND OF THE INVENTION

1. Field of the Invention

The invention relates to a fan and fan housing with an air-guiding function, and in particular, to a fan and a fan housing with a connecting element having a plurality of air-guiding teeth for enhancing heat dissipation efficiency.

2. Description of the Related Art

Generally, a fan housing of a conventional axial-flow fan comprises ribs or stator blades at its air outlet. FIG. 1 shows a fan housing 1, comprising a frame 10, a base 11 disposed in the frame 10, and a plurality of ribs 12 disposed between the base 11 and the frame 10. The ribs 12 are just to connect the base 11 and the frame 10 without any improvement in heat dissipation of the fan. FIG. 2 shows a fan housing, comprising a frame 10, a base 11 disposed in the frame 10, and a plurality of stator blades 13 connected with the frame 10 and the base 11. The stator blades 13 are utilized not only for connection, but also for guiding the air when the air passes through the air outlet of the housing. However, when blades rotate in the fan housing with the stator blades, unfavorable turbulence occurs at the air outlet of the fan housing and a stagnation zone is accordingly formed at the air outlet, and thus, heat dissipation effect decreases. To solve this problem, the stator blades have to be moved toward the inside of the fan housing, which usually reduces and affects the rotating space of the blades, and causes unfavorable results for miniature fan.

Thus, a fan housing with tooth-type connecting elements of the present invention is provided to overcome the disadvantages of the prior art.

BRIEF SUMMARY OF THE INVENTION

A fan and fan housing with tooth-typed connecting elements are provided. The fan comprises a plurality of connecting elements at the air outlet of the fan housing, and each connecting element comprises a plurality of air-guiding teeth. Thus, the air passing through the connecting elements can be smoothly guided out of the fan to prevent the occurrence of the stagnation zone.

Specifically, the fan comprises a fan housing and an impeller. The fan housing comprises a frame, a base disposed in the frame, and a plurality of connecting elements disposed between the frame and the base. A plurality of air-guiding teeth are formed on at least one edge of the connecting elements, so that the air passing though the connecting elements can be smoothly guided out of the fan to prevent the turbulence and the occurrence of the stagnation zone, and thus increase the air pressure and air flow and reduce the noise. Accordingly, the connecting elements need not be moved toward the inside of the fan housing and the size of the fan housing can be minimized.

Particularly, the connecting elements can be ribs or stator blades, and the air-guiding teeth can be formed on a leading edge of the connecting element, which faces the inside of the fan housing, or formed on a trailing edge of the connecting element, which faces the exterior of the housing. Furthermore, the air-guiding teeth can be formed on both the leading and trailing edges.

Additionally, the shape of the air-guiding teeth is not limited, which can be rectangular, square, arched, circular, canine, saw-like and etc.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
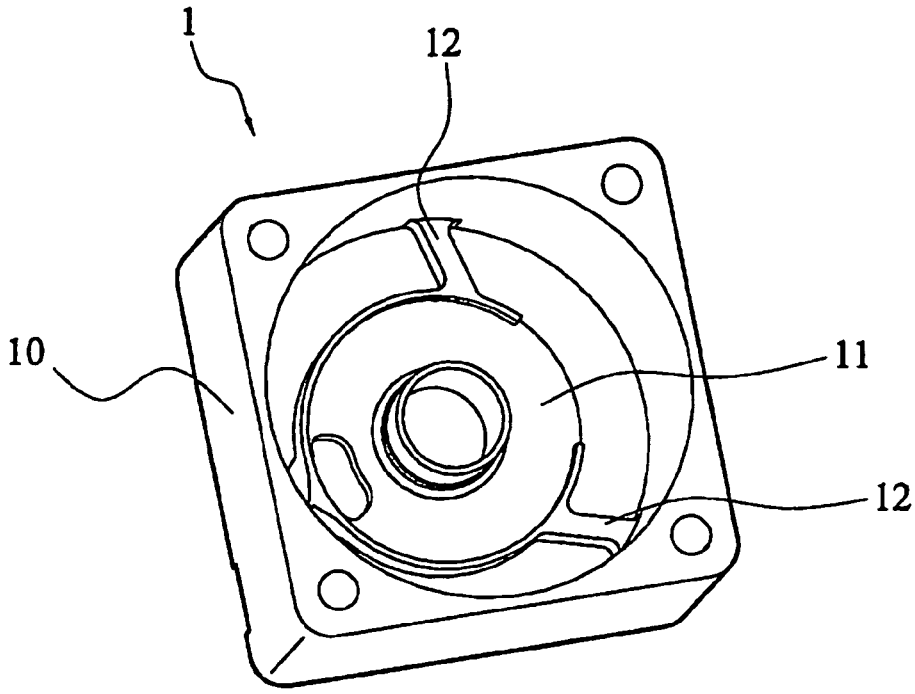
FIG. 1 (RELATED ART)
FIG. 1 is a 3-D schematic view of a conventional axial-flow fan with ribs.
Figure 2:
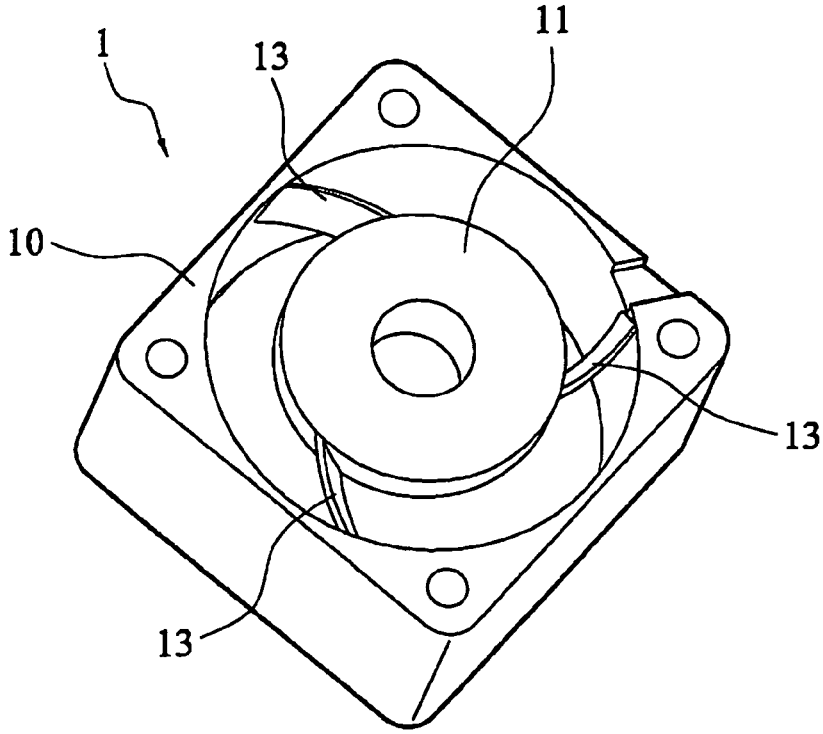
FIG. 2 (RELATED ART)
FIG. 2 is a 3-D schematic view of a conventional axial-flow fan with stator blades.
Figure 3:
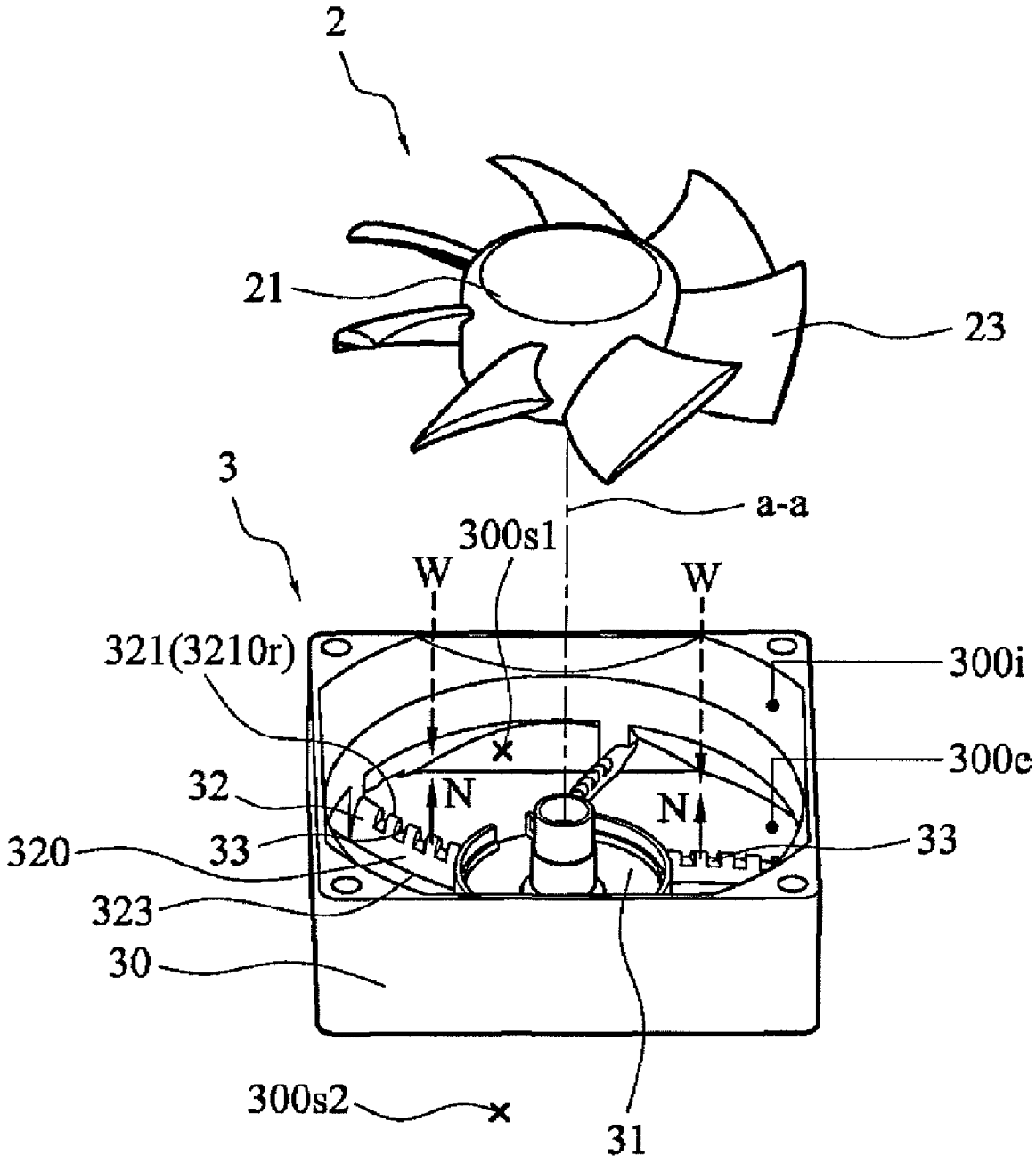
FIG. 3 is an exploded schematic view of an embodiment of a fan of the present invention.
Figure 4:
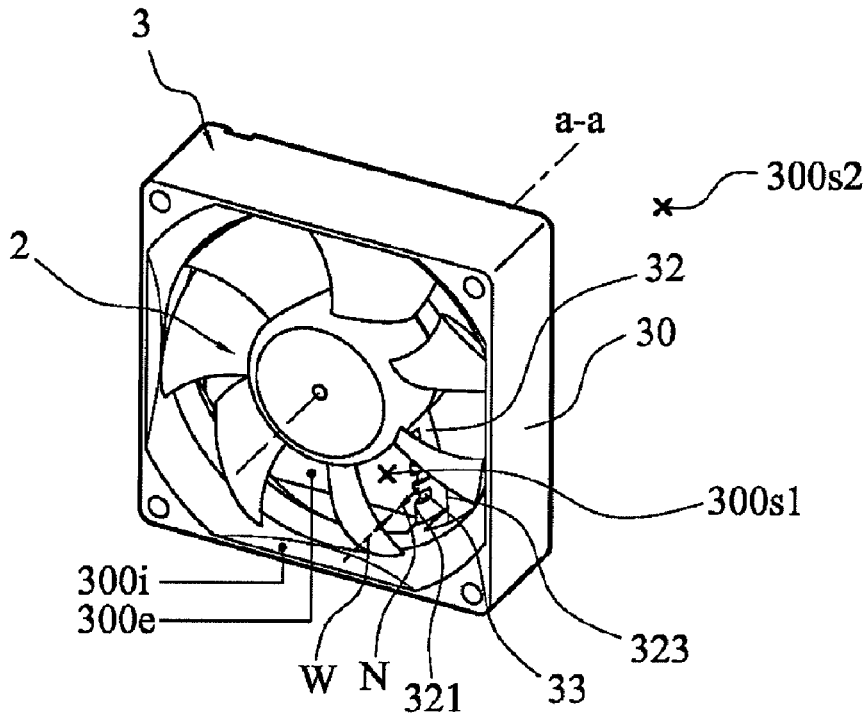
FIG. 4 is a 3-D assembled view of the fan in FIG. 3.
Figure 5:
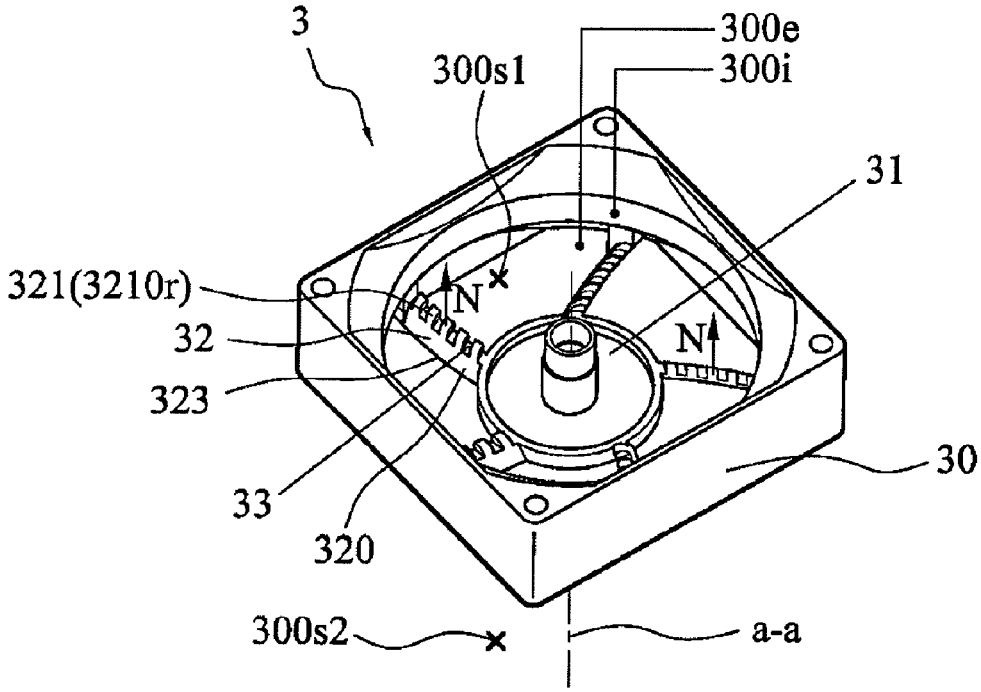
FIG. 5 is a 3-D schematic view of the fan housing in FIG. 3.

Referring to FIG. 3 and FIG. 4, a fan comprises a fan housing 3 and an impeller 2 disposed in the fan housing 2. The impeller 2 comprises a hub 21 and a plurality of blades 23 disposed around the hub 21. Referring also to FIG. 5, the fan housing 3 comprises a substantially rectangular frame 30 having an inlet 300*i* and an outlet 300*e*, a circular base 31 disposed in the frame 30 and close to the outlet 300*e* of the frame 30, and a plurality of connecting elements 32 disposed between the frame 30 and the circular base 31 and located close to the outlet 300*e* of the frame 30. The connecting elements 32 are stator blades, each of which comprises a leading edge (first edge) 321 facing the impeller 2, a trailing edge (second edge) 323 facing the exterior 300*s*2 of the frame 30, a portion 320 including the trailing edge (second edge), and, a plurality of air-guiding teeth 33 protruded from the portion 320 along the axial line a-a of the frame 30 and formed on the first edge 321 to axially direct to the interior 300*s*1 of the frame 30. That is, the leading edge (first edge) 321 faces the interior 300*s*1 of the frame 30, and the trailing edge (second edge) 323 opposite to the leading edge (first edge) 321 faces the exterior 300*s*2 of the frame 30. Thus, an extending direction N of the air-guiding teeth 33 is parallel to a direction W of airflows passing but is opposite to the direction W of the airflows passing.

Figure 6:
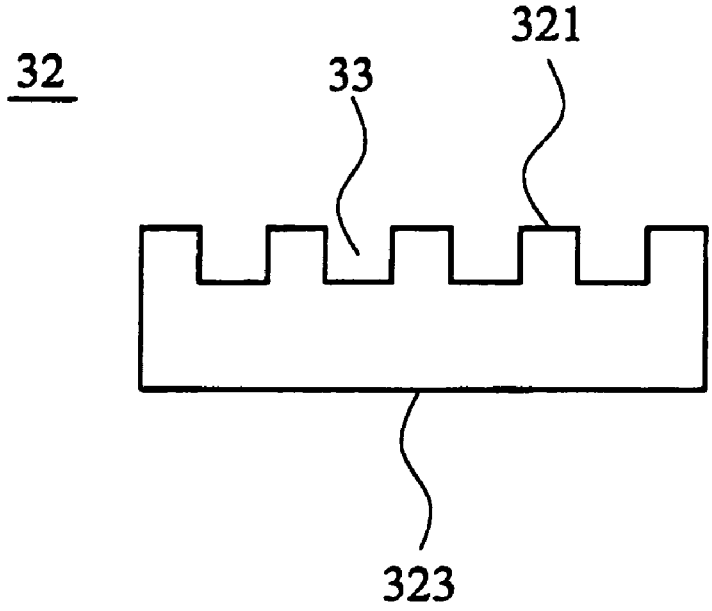
FIG. 6 is a side view of an embodiment of the connecting element.

Each connecting element 32 comprises the plurality of air-guiding teeth 33. Each of the first edges 321 of the plurality of connecting elements 32 comprises a wave profile 3210*r* comprising the plurality of air-guiding teeth 33 is radially arranged with respect to the axial line a-a of the frame 30. The air-guiding teeth 33 are arranged along the leading edge 321 of the connecting element 32, so that the leading edge 321 is not a smooth curve, as shown in FIG. 6. The side view of the depth and width of the air-guiding teeth depend on the size of the fan and operational conditions. In this embodiment, the air-guiding teeth 33 formed on the connecting element 32 are with equivalent intervals; and the base 31, the frame 30, the connecting elements 32, and the air-guiding teeth are integrally formed by injection molding. That is, the air-guiding teeth 33 are axially arranged and parallel to an axial line a-a of the frame 30.

Figure 7:
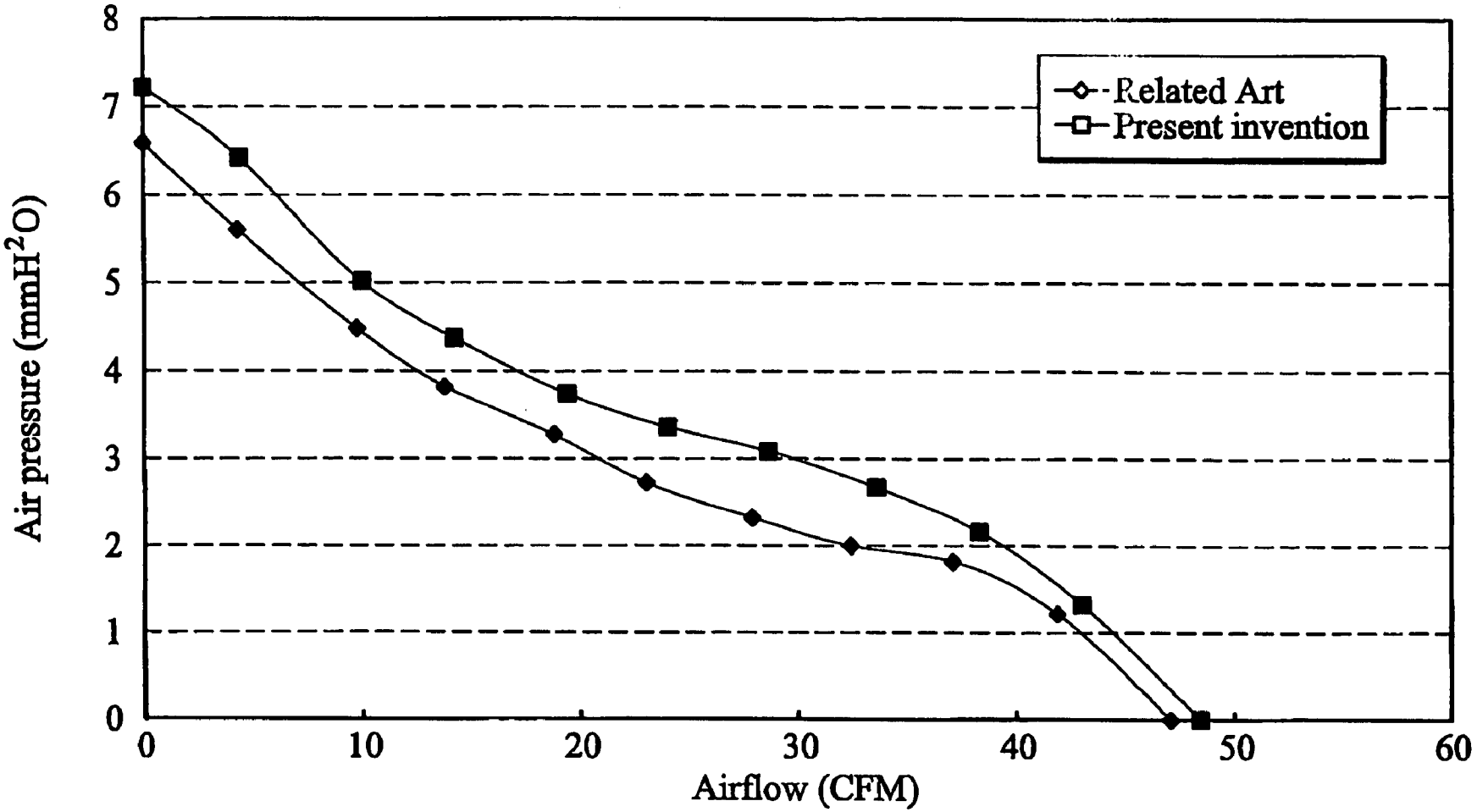
FIG. 7 is a graph illustrating air pressure versus air flow of the conventional fan and the fan of the embodiment.

When the impeller 2 rotates to produce the airflow traveling from the inlet 300*i* toward the outlet 300*e* of the frame 30, the airflow can flow out smoothly along the connecting elements 32. Furthermore, the air-guiding teeth 33 of the connecting elements 32 can guide the airflow efficiently flow out of the fan housing 3 and reduce the turbulence and the stagnation zone near the air outlet of the frame 30. Accordingly, the air pressure and the airflow can be increased effectively and noise can be reduced due to the extending direction N of the air-guiding teeth 33 opposite to the direction W of the airflows passing, i.e., the air-guiding teeth 33 are utilized to axially reduce noise caused by airflows. FIG. 7 is a graph illustrating air pressure versus air flow of a conventional fan and an embodiment of the fan of the invention under 3800 RPM. As shown in FIG. 7, the airflow and the air pressure of the fan with air-guiding teeth 33 are relatively increased. The maximum air flow is increased by approximately 50% and the maximum air pressure is increased by approximately 35%. Furthermore, the tone value of noise is reduced by approximately 50%, that is, noise is reduced greatly. Additionally, the connecting elements 32 do not need to move toward the inside of the fan; thus, the size of the fan housing can be minimized.

Figure 8A:
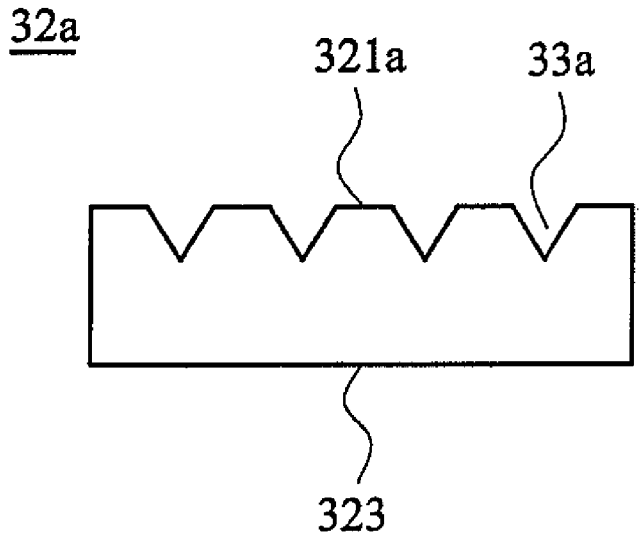
FIG. 8A is a schematic view of the air-guiding teeth in the shape of canine teeth on the leading edge of the connecting element.
Figure 8B:
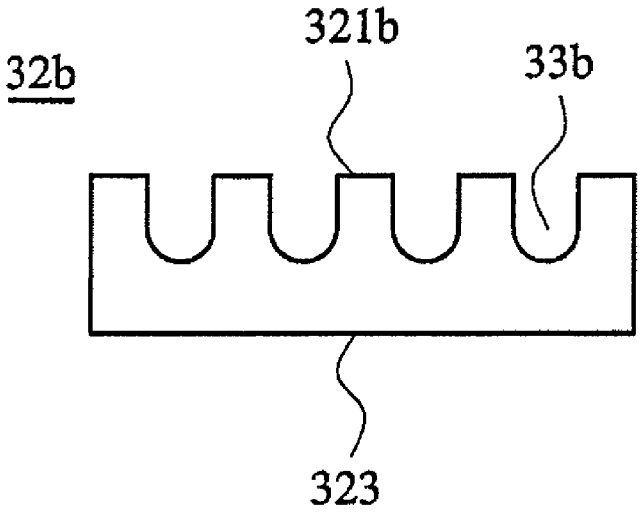
FIG. 8B is a schematic view of the air-guiding teeth in the shape of arched teeth on the leading edge of the connecting element.

The shape of the air-guiding teeth 33 is not limited to the rectangular teeth, but can also be canine teeth 33*a* (formed at a leading edge 321*a* of a connecting elements 32*a* as shown in FIG. 8A), arched teeth 33*b* (formed at a leading edge 321*b* of a connecting elements 32*b* as shown in FIG. 8B), circular teeth, saw teeth, square teeth and etc., or combination thereof.

Figure 9:
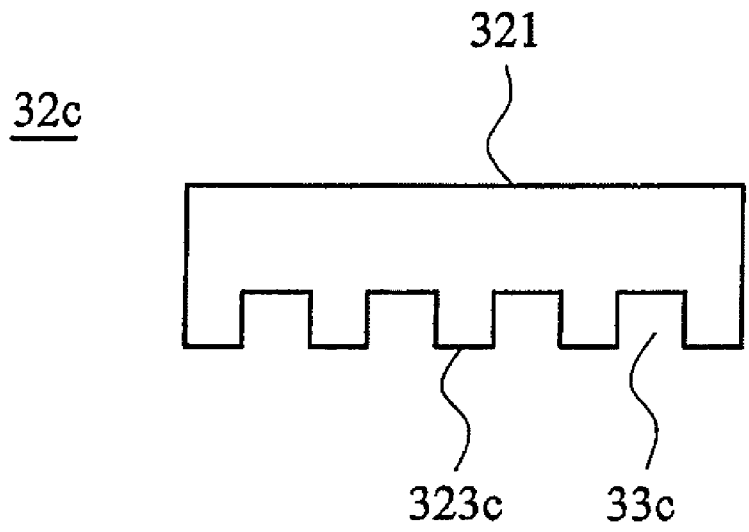
FIG. 9 is a schematic view of the air-guiding teeth in the shape of rectangular teeth on the trailing edge of the connecting element.
Figure 10:
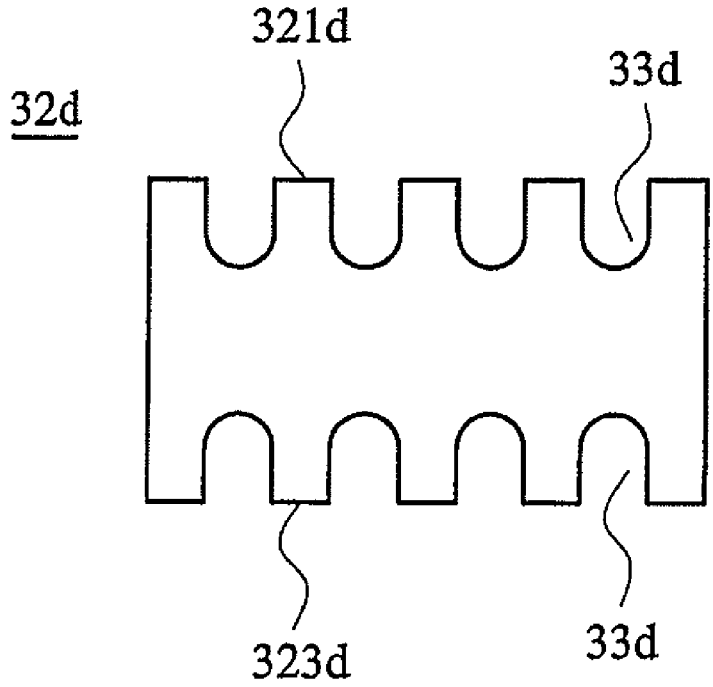
FIG. 10 is a schematic view of the air-guiding teeth in the shape of arched teeth at two edges of the connecting element.

Although the described air-guiding teeth 33 are formed on the leading edge 321 of the connecting element 32, the air-guiding teeth 33*c* can be formed on the trailing edge 323*c* of the connecting element 32*c*, as shown in FIG. 9. Additionally, the plurality of air-guiding teeth 33*d* can be formed at both the leading edge 321*d* and the trailing edge 323*d* of the connecting element 32*d*, as shown in FIG. 10. The shape and the position of the air-guiding teeth are not limited, and the air-guiding teeth 33 formed on the leading edge 321 and the trailing edge 323 can be symmetrical, non-symmetrical, or staggered.

Note that the connecting elements further can be ribs as shown in the related art. The air-guiding teeth can be formed toward the exterior of the fan housing, or toward the interior of the fan housing, or toward both.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

The invention claimed is:

1. A fan housing comprising:

a frame comprising an outlet and an axial line;

a base disposed in the frame and close to the outlet of the frame; and a plurality of connecting elements disposed between the frame and the base, and close to the outlet of the frame, wherein at least one of the plurality of connecting elements has a first edge facing the interior of the frame, a second edge opposite to the first edge and facing the exterior of the frame, and a plurality of air-guiding teeth formed on the first edge to axially direct to the interior of the frame, and an extending direction of the plurality of air-guiding teeth is parallel to a direction of airflows passing but is opposite to the direction of the airflows passing;

wherein each of the first edges of the plurality of connecting elements comprises a wave profile comprising the plurality of air-guiding teeth is radially arranged with respect to the axial line of the frame.

2. The fan housing as claimed in claim 1, wherein the plurality of connecting elements are stator blades or ribs.

3. The fan housing as claimed in claim 1, wherein the plurality of air-guiding teeth are also formed on the second edge and facing the exterior of the frame.

4. The fan housing as claimed in claim 3, wherein the plurality of air-guiding teeth formed on the first and second edges of the connecting element are symmetrical or staggered to each other.

5. The fan housing as claimed in claim 1, wherein the side view of the plurality of air-guiding teeth are rectangular teeth, square teeth, arched teeth, circular teeth, saw teeth, canine teeth, or the combination thereof.

6. The fan housing as claimed in claim 1, wherein the plurality of air-guiding teeth formed on the connecting element are arranged at equivalent intervals.

7. The fan housing as claimed in claim 1, wherein the shapes and sizes of the plurality of air-guiding teeth are the same.

8. A fan comprising:

a fan housing comprising:

a frame comprising an outlet and an axial line;

a base disposed in the frame and close to the outlet of the frame; and a plurality of connecting elements disposed between the frame and the base, and close to the outlet of the frame, at least one of the plurality of the connecting elements comprising a first edge facing the interior of the frame, a second edge opposite to the first edge and facing the exterior of the frame, and a plurality of air-guiding teeth formed on the first edge to axially direct to the interior of the frame, wherein each of the first edges of the plurality of connecting elements comprises a wave profile comprising the plurality of air-guiding teeth is radially arranged with respect to the axial line of the frame; and an impeller disposed in the fan housing and supported by the base, rotated along the axial line of the frame to produce airflows;

wherein an extending direction of the plurality of air-guiding teeth is parallel to a direction of the airflows passing but is opposite to the direction of the airflows passing.

9. The fan as claimed in claim 8, wherein the impeller comprises a hub and a plurality of blades disposed around the hub.

10. The fan as claimed in claim 8, wherein the plurality of connecting elements are stator blades or ribs.

11. The fan as claimed in claim 8, wherein the plurality of air-guiding teeth are further formed on the second edge of the at least one of the plurality of the connecting elements and facing the exterior of the frame.

12. The fan as claimed in claim 11, wherein the plurality of air-guiding teeth formed on the first and second edges of the connecting element are symmetrical or staggered to each other.

13. The fan as claimed in claim 8, wherein the side view of the plurality of air-guiding teeth are rectangular teeth, square teeth, arched teeth, circular teeth, saw teeth, canine teeth or the combination thereof.

14. The fan as claimed in claim 8, wherein the plurality of air-guiding teeth formed on the connecting element are arranged with equivalent intervals.

15. The fan as claimed in claim 8, wherein the shapes and sizes of the plurality of air-guiding teeth are the same.

16. The fan as claimed in claim 8, wherein the base, the frame, the plurality of connecting elements, and the plurality of air-guiding teeth are integrally formed by injection molding.

17. The fan as claimed in claim 8, wherein the plurality of air-guiding teeth formed on the first edge face the impeller.

18. The fan as claimed in claim 8, wherein the plurality of air-guiding teeth formed on the first edge of the connecting element are radially arranged.

19. The fan as claimed in claim 11, wherein the plurality of air-guiding teeth formed on the first and second edges of the connecting element are radially arranged.

20. The fan housing as claimed in claim 3, wherein the plurality of air-guiding teeth formed on the first and second edges of the connecting element are radially arranged.

* * * * *